US008261396B2

(12) United States Patent
Chew

(10) Patent No.: US 8,261,396 B2
(45) Date of Patent: Sep. 11, 2012

(54) CEILING FAN CLEANER WITH ROTATABLE ROLLER CLEANER

(76) Inventor: Thye Hin Chew, Pulau Pinang (MY)

( * ) Notice: Subject to any disclaimer, the term of this patent is extended or adjusted under 35 U.S.C. 154(b) by 37 days.

(21) Appl. No.: 12/988,718

(22) PCT Filed: Apr. 16, 2009

(86) PCT No.: PCT/MY2009/000054

§ 371 (c)(1),
(2), (4) Date: Oct. 20, 2010

(87) PCT Pub. No.: WO2009/131432

PCT Pub. Date: Oct. 29, 2009

(65) Prior Publication Data

US 2011/0035891 A1 Feb. 17, 2011

(30) Foreign Application Priority Data

Apr. 24, 2008 (MY) ..... PI20081244

(51) Int. Cl.
*A46B 13/02* (2006.01)
*A46B 13/08* (2006.01)
*A47L 25/00* (2006.01)

(52) U.S. Cl. ..... 15/97.1; 15/23; 15/25; 15/230.11

(58) Field of Classification Search ..... 15/23–26, 15/46, 52.1, 88.4, 98, 103.5, 97.1, 160, 210.1, 15/230.11
See application file for complete search history.

(56) References Cited

U.S. PATENT DOCUMENTS 92,929 A * 7/1869 Baker ..... 15/46
125,369 A * 4/1872 Willey et al. ..... 15/46
497,175 A * 5/1893 Hassard ..... 15/25
887,867 A * 5/1908 Stoerr et al. ..... 15/23
1,474,994 A * 11/1923 Brown ..... 15/23
1,557,551 A * 10/1925 Bertone ..... 15/23
1,692,744 A * 11/1928 Kaplan ..... 15/23
1,697,534 A * 1/1929 Macready et al. ..... 15/53.2
1,721,655 A * 7/1929 Carlson ..... 15/23

(Continued)

FOREIGN PATENT DOCUMENTS

BR 8902440 A1 11/1990

(Continued)

OTHER PUBLICATIONS

"Machine Translate of Abstract of PI 8902440".

(Continued)

*Primary Examiner* — Mark Spisich
(74) *Attorney, Agent, or Firm* — Preston Smirman; Smirman IP Law, PLLC

(57) ABSTRACT

The present invention is a ceiling fan cleaning apparatus comprising a roller cleaner (20) enveloping a central hub (22) and rotatable with respect to the central hub (22), the central hub (22) attached at one end to an elongated member (10), and a first pulley (32) connected fixedly to one end of the roller cleaner (20) and such that rotation of the first pulley (32) causes an equal rotation of the roller cleaner (20), and a second pulley (34) located close to a second end of the elongated member (10) and a chain (36) connecting the first and second pulleys (32, 34). A hand crank (38) is connected to the second pulley (34) so that a user is able to rotate the roller cleaner (20) by turning the hand crank (38).

14 Claims, 5 Drawing Sheets

U.S. PATENT DOCUMENTS

| | | | | | |
|---|---|---|---|---|---|
| 1,882,471 | A | * | 10/1932 | Beach | 15/52.1 |
| 1,951,851 | A | * | 3/1934 | Turner | 15/23 |
| 1,959,307 | A | * | 5/1934 | Sanger | 15/23 |
| 2,127,051 | A | * | 8/1938 | Atkinson | 15/98 |
| 2,250,975 | A | * | 7/1941 | Sussman | 15/22.1 |
| 3,172,138 | A | * | 3/1965 | Price | 15/98 |
| 3,406,417 | A | * | 10/1968 | Niles et al. | 15/4 |
| 3,665,546 | A | * | 5/1972 | Horeni | 15/383 |
| 3,724,016 | A | * | 4/1973 | Soffer | 15/98 |
| 5,319,821 | A | | 6/1994 | Nicholson et al. | |
| 2006/0107475 | A1 | * | 5/2006 | Swenson | 15/97.1 |
| 2006/0118656 | A1 | * | 6/2006 | Griffith | 239/280 |

FOREIGN PATENT DOCUMENTS

| | | | |
|---|---|---|---|
| CN | 201157344 | A1 | 12/2008 |

OTHER PUBLICATIONS

"Machine Translate of Abstract of CN201157344".

* cited by examiner

CEILING FAN CLEANER WITH ROTATABLE ROLLER CLEANER

CROSS-REFERENCE TO RELATED APPLICATION

The instant application claims priority to Malaysian Patent Application No. P120081244, filed Apr. 24, 2008, pending, and PCT International Application No. PCT/MY2009/000054, filed on Apr. 16, 2009, pending, the entire specifications of both of which are expressly incorporated herein by reference.

FIELD OF INVENTION

This invention relates to an apparatus for cleaning the surfaces of ceiling fans.

BACKGROUND OF THE INVENTION

There are currently several varieties of apparatuses for cleaning ceiling fans. Many of these have disadvantages when it comes to cleaning the upper surface of the ceiling fan blades, forcing the user to use a ladder or stool to reach the upper blade surfaces. Other cleaning tools require bulky vacuums or attachments which limit reach and mobility. Furthermore, none of these inventions give the user a view of the top side of the ceiling fan blade being cleaned.

Most of these inventions use a wiping or sweeping method with a fixed brush or cleaning surface to remove dust from the top side of the ceiling fan blade. U.S. Pat. No. 5,319,821 (Nicholson, et al) describes "a mounted brush which is designed to clean the exterior surfaces of a ceiling fan". The problem with fixed cleaning devices is that the entire device has to be moved along with the cleaning surface for each sweep, and several sweeps are often necessary to achieve the desired result.

It is thus an object of the present invention to provide an improved means for cleaning the surfaces of a ceiling fan, including the blade, central portion/motor housing, and any other accessories such as light fixtures while the user remains safely on ground level.

It is a further object of the invention to provide an apparatus for cleaning the surfaces of a ceiling fan effectively and without the need for moving the entire device for several sweeps of the fan blade by providing a rotatable roller cleaner as the cleaning device.

It is still a further object of the invention to provide an apparatus for cleaning the surfaces of a ceiling fan that allows the user to view substantially the top side of the ceiling fan blade being cleaned.

SUMMARY OF THE INVENTION

The present invention is a ceiling fan cleaning apparatus comprising a roller cleaner enveloping a central hub and rotatable with respect to the central hub, the central hub attached at one end to an elongated member, and a first pulley connected fixedly to one end of the roller cleaner and such that rotation of the first pulley causes an equal rotation of the roller cleaner, and a second pulley located close to a second end of the elongated member and a chain connecting the first and second pulleys. A hand crank is connected to the second pulley so that a user is able to rotate the roller cleaner by turning the hand crank.

The roller cleaner has a width substantially equal to the standard width of a ceiling fan blade. There is provided a pair of circular protrusions at each end of the roller cleaner that restricts the lateral movement of the roller cleaner to a path substantially within the area of the ceiling fan blade.

In one embodiment of the present invention, there is also provided a mirror attached at the top end of the elongated member such that during operation, a user will be able to view the top surface of the ceiling fan blade being cleaned.

The length of the elongated member is adjustable to accommodate differing heights of both the ceiling fan and the user.

The roller cleaner may be disposable or removable to facilitate changing of a used cleaning surface. Alternatively, only the cleaning surface of the roller cleaner may be removed and changed, leaving the bulk of the roller cleaner unchanged, thus lowering the cost of changing the cleaning surface.

DETAILED DESCRIPTION OF THE INVENTION

It should be noted that the following detailed description is directed to a ceiling fan cleaner with a rotatable roller cleaner and is not limited to any particular size, shape or configuration of the ceiling fan cleaner.

Figure 1:
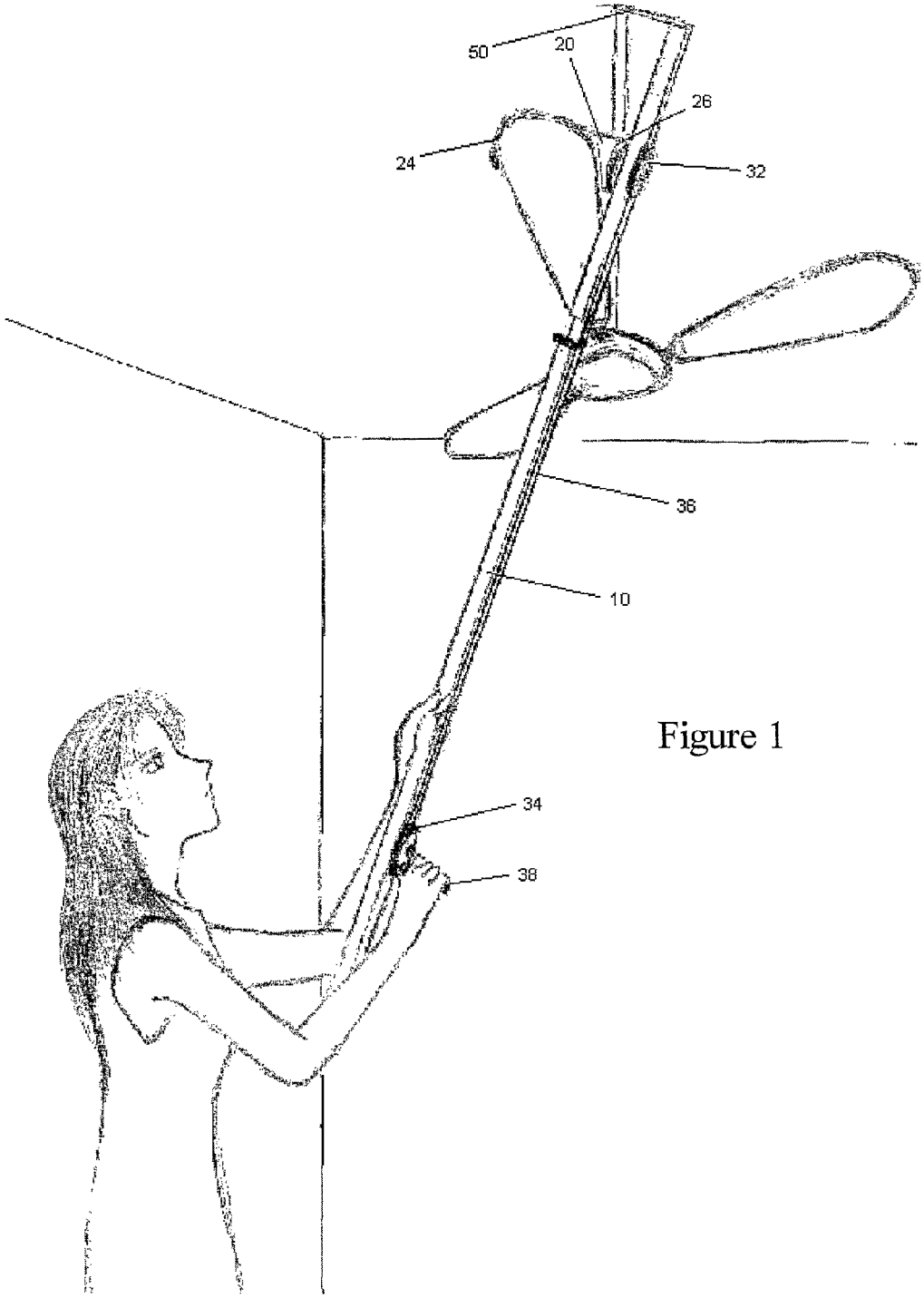
FIG. 1 shows an overall view of the ceiling fan cleaner in an embodiment of the present invention.
Figure 2:
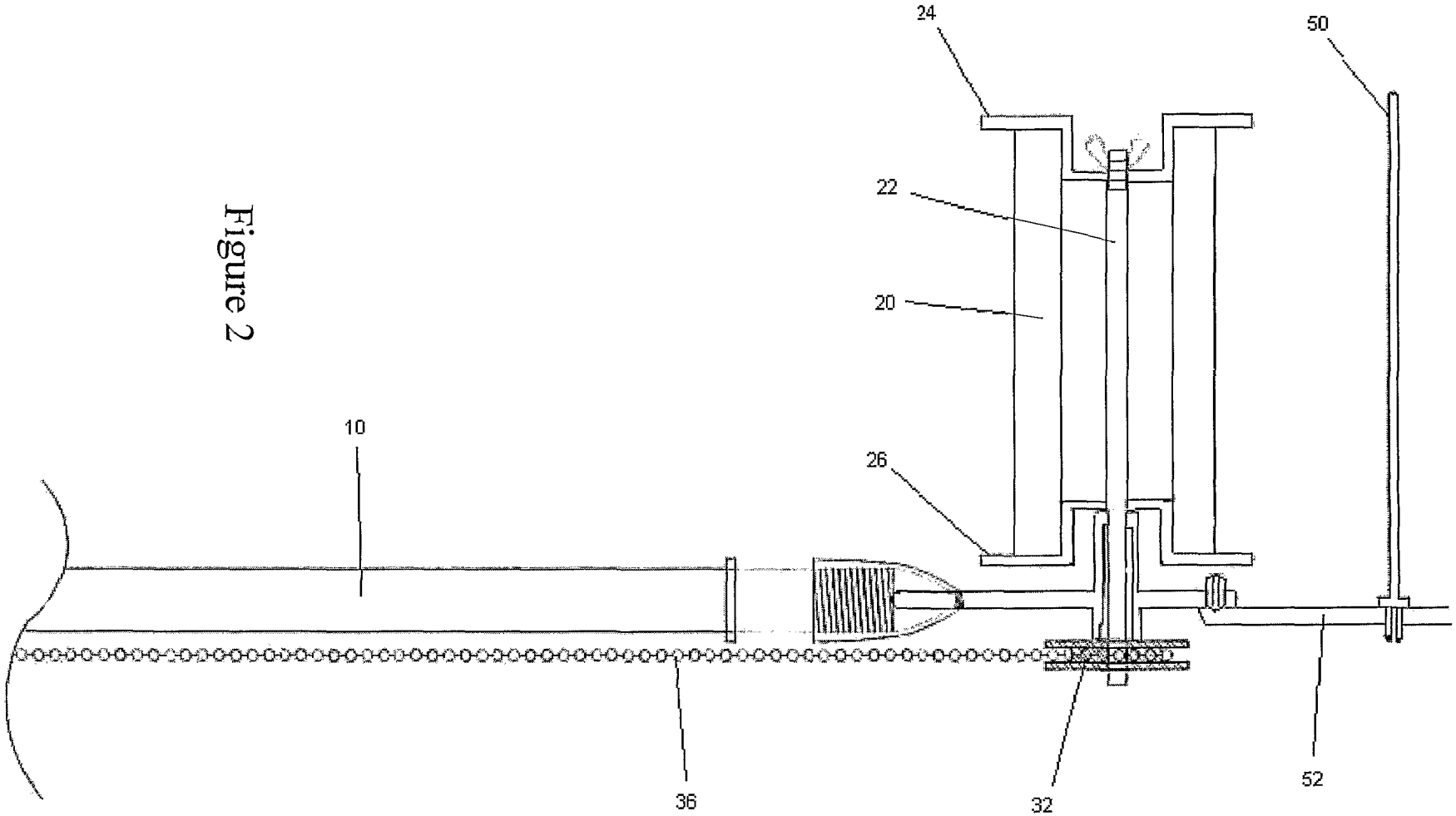
FIG. 2 shows a side view of the ceiling fan cleaner in an embodiment of the present invention.

Referring to FIGS. 1 and 2, there can be seen a roller cleaner (20) circumferentially enveloping a central hub (22), the roller cleaner (20) being rotatable with respect to the central hub (22). The central hub (22) is attached at one end to an elongated member (10), and at a location close to a first (higher) end of the elongated member (10). The rotation of the roller cleaner (20) is remotely controlled from a position substantially close to a second (lower) end of the elongated member (10).

The means of rotating the roller cleaner (20) comprises a first (higher) pulley (32) connected fixedly to one end of the roller cleaner (20) and such that rotation of the first pulley (32) causes a substantially equal rotation of the roller cleaner (20). A second (lower) pulley (34) is located close to the said second end of the elongated member (10), and a chain (36) connects first pulley (32) and second pulley (34) such that rotation of the second pulley (34) causes a substantially equal rotation of the first pulley (32). The connecting means between the first pulley (32) and second pulley (34) can also be a belt, string, rope or other similar methods.

A hand crank (38) is connected to the second pulley (34) such that a rotation of the hand crank (38) will cause a substantially equal rotation of the second pulley (34). The overall effect of this is that a rotation of the hand crank (38) will cause a substantially equal rotation of the roller cleaner (20).

The roller cleaner (20) has a width substantially equal to the standard width of a ceiling fan blade. Still referring to FIGS. 1 and 2, there can be seen a pair of circular protrusions (24, 26) at each end of the roller cleaner (20). The circular protrusions (24, 26) restrict the lateral movement of the roller cleaner (20) to a path substantially within the area of the ceiling fan blade.

There is also a mirror (50) attached to an extension member (52) which is in turn attached at the first (higher) end of the elongated member (10). During operation, a user will be able to view substantially a top surface of a ceiling fan blade being cleaned using this mirror (50).

The length of the elongated member (10) can be adjusted to accommodate for differing heights of ceiling fans and users.

Figure 3:
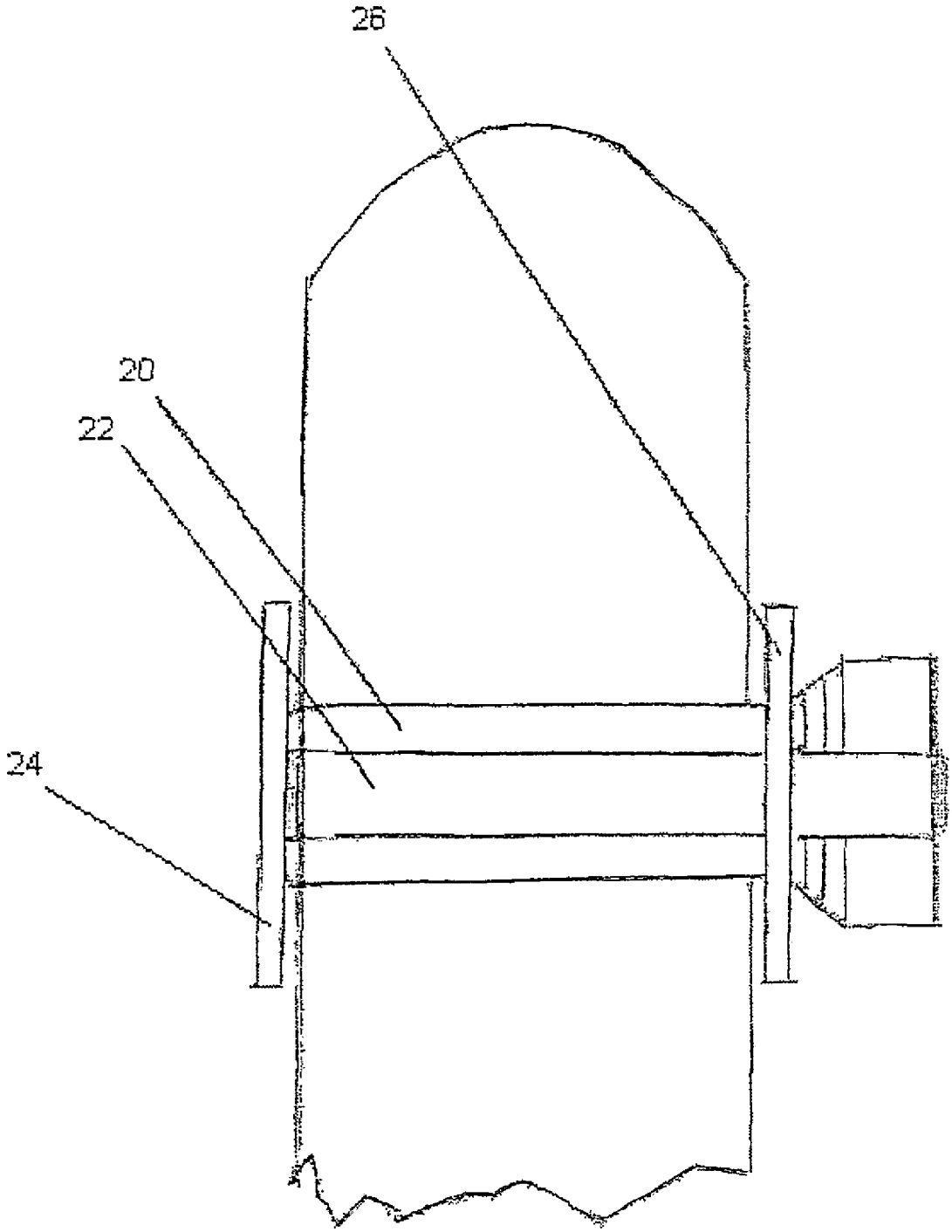
FIG. 3 shows a top view of the roller in an embodiment of the present invention.

Referring to FIG. 3, there can be seen from a top view the roller cleaner (20) being used during a cleaning operation. The central hub (22) moves along the length of the fan blade but does not rotate. The roller cleaner (20) is rotated by the user. The rotation of the roller cleaner (20) causes the cleaning surface to rub against the fan blade surface. There are two circular protrusions (24, 26) that restrict the lateral movement of the roller cleaner (20) to a path substantially within the area of the ceiling fan blade.

Figure 4:
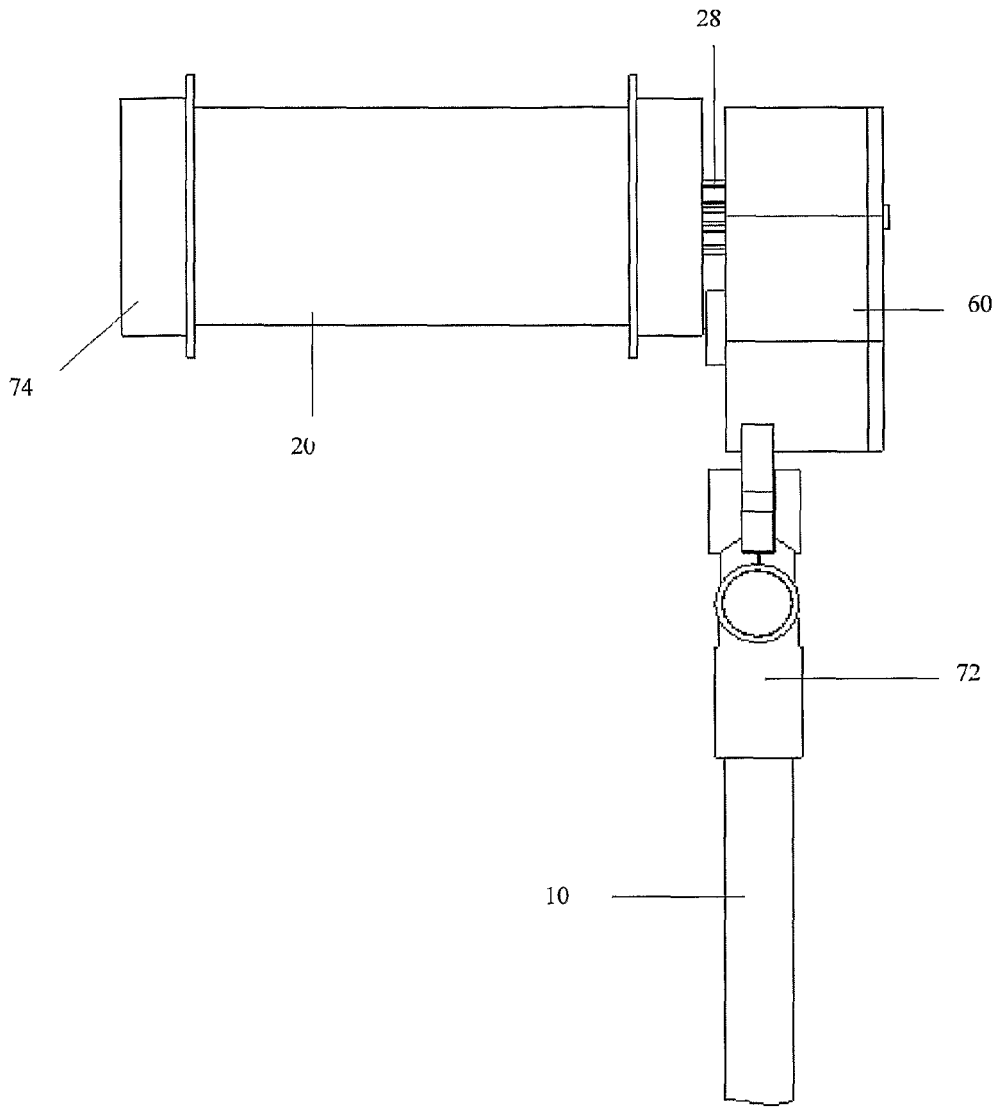
FIG. 4 shows an overall view of the ceiling fan cleaner in another embodiment of the present invention.
Figure 5:
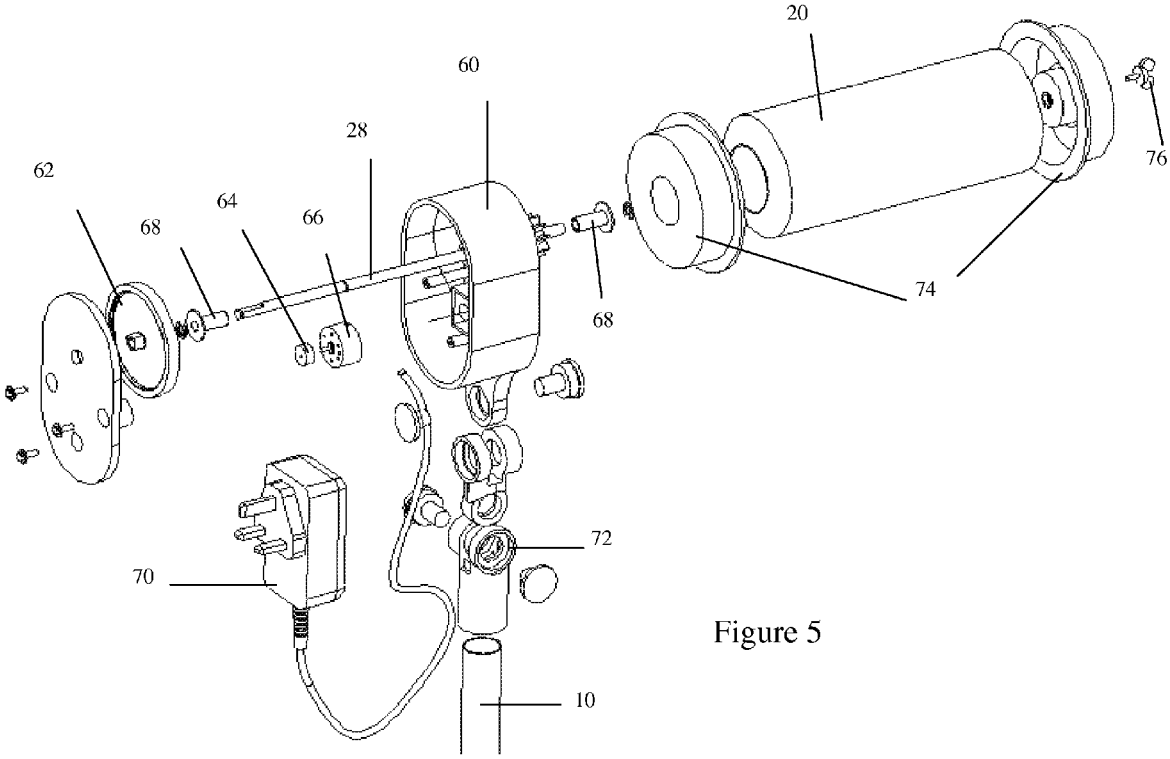
FIG. 5 shows an exploded view of the ceiling fan cleaner in another embodiment of the present invention.

In another embodiment of the invention, referring to FIGS. 4 and 5, the means of rotating the roller cleaner (20) comprises a shaft (28) having one end connected fixedly to one end of the roller cleaner (20) and such that rotation of the shaft (28) causes a substantially equal rotation of the roller cleaner (20); a gear assembly (60) connected to second end of the shaft (28); a motor 66 connected to the gear assembly (60) to drive the gear assembly (60) such that rotation of the gear assembly (60) causes a substantially equal rotation of the shaft (28). The gear assembly (60) comprises a main gear (62) attached to second end of the shaft 28 and a pinion gear (64) located between the main gear (62) and the motor (66). An adaptor (70) electrically coupled to the motor (66) to be connected to an electrical socket to provide power for driving the motor (66). A pair of rotation bushes (68) located at each end of the shaft (28) to reduce friction and wear during the rotation movement. A hinge bracket (72) is connected between the housing of the gear assembly (60) and the elongated member (10) to provide the angle adjustment function for the roller cleaner. A pair of brush caps (74) is located at both end of the roller cleaner to hold the roller cleaner in place. A wing nut (76) is used to fasten the brush cap (74) and one end of the roller cleaner together.

During the operation, the motor (66) attached with the pinion gear (64) inside the housing will rotate the main gear (62) where it propel brush and brush cap (74) via the shaft (28). The motor and the pinion gear (64) will rotate in a relatively fast speed and high number of rotations. Thus, the main gear (62) able to reduce the number of rotations driven by the motor (66) and the pinion gear (64), which are adequately in wiping process and dirt removing work for the ceiling fan. The roller cleaner can be soak or dip into water, soap or any detergents.

The roller cleaner can be replaced after a prolong period of usages. This can be done by loosening the wing nut (76) and to remove bush cap (74) and roller cleaner. However, the user need to ensure that the roller brush is damp before fitting back for the fan fin cleaning process otherwise the spinning will swing out all the dripping water, soap or any detergent.

While several particularly preferred embodiments of the present invention have been described and illustrated, it should now be apparent to those skilled in the art that various changes and modifications can be made without departing from the spirit and scope of the invention. Accordingly, the following claims are intended to embrace such changes, modifications, and areas of application that are within the spirit and scope of this invention.

The invention claimed is:

1. A ceiling fan cleaning apparatus, comprising:

an elongated member;

a roller cleaner enveloping a central hub and rotatable with respect to the central hub, the central hub attached at one end to the elongated member, and at a location close to a first end of the elongated member, wherein the roller cleaner has a width substantially equal to the standard width of a ceiling fan blade, and comprises a pair of circular protrusions at each end of the roller cleaner, the circular protrusions restricting the lateral movement of the roller cleaner to a path substantially within the area of the ceiling fan blade; and a rotation system selectively operable to rotate the roller cleaner remotely, wherein rotation of the roller cleaner is controllable from a position substantially close to a second end of the elongated member.

2. A ceiling fan cleaning apparatus according to claim 1, wherein the rotation system comprises:

a first pulley connected fixedly to one end of the roller cleaner, wherein rotation of the first pulley causes a substantially equal rotation of the roller cleaner;

a second pulley located close to the second end of the elongated member; and a connector between the first pulley and second pulley, wherein rotation of the second pulley causes a substantially equal rotation of the first pulley.

3. The ceiling fan cleaning apparatus according to claim 2, wherein the connector between the first pulley and second pulley is selected from the group consisting of a chain, belt, string, or rope.

4. The ceiling fan cleaning apparatus according to claim 2, further comprising a manual hand crank connected to the second pulley, wherein rotation of the hand crank will cause a substantially equal rotation of the second pulley.

5. The ceiling fan cleaning apparatus according to claim 1, further comprising a mirror attached at the first end of the elongated member such that during operation, a user will be able to view at least a portion of a top surface of a ceiling fan blade being cleaned.

6. The ceiling fan cleaning apparatus according to claim 1, wherein the elongated member has an adjustable length.

7. The ceiling fan cleaning apparatus according to claim 1, wherein the roller cleaner comprises an outer layer of cleaning material designed to wipe dust from surfaces.

8. The ceiling fan cleaning apparatus according to claim 7, wherein the cleaning material is removable from the roller cleaner so that it may be replaced.

9. The ceiling fan cleaning apparatus according to claim 1, wherein the roller cleaner comprises an outer layer of cleaning material designed to soak up an amount of liquid for the purpose of wiping dust from surfaces, and wherein the liquid is either water or any type of cleaning detergents.

10. A ceiling fan cleaning apparatus comprising:

an elongated member;

a roller cleaner enveloping a central hub and rotatable with respect to the central hub, the central hub attached at one end to the elongated member, and at a location close to a first end of the elongated member a pair of brush caps is located at both ends of the roller cleaner respectively to hold the roller cleaner in place; and a rotation system selectively operable to rotate the roller cleaner, wherein the rotation system comprises a shaft, a gear assembly and a motor, the shaft having one end connected fixedly to one end of the roller cleaner, wherein rotation of the shaft causes a substantially equal rotation of the roller cleaner;

the gear assembly connected to second end of the shaft; and the motor connected to the gear assembly to drive the gear assembly, wherein rotation of the gear assembly causes a substantially equal rotation of the shaft.

11. The ceiling fan cleaning apparatus according to claim 10, wherein the gear assembly comprises a main gear attached to second end of the shaft and a pinion gear located between the main gear and the motor.

12. The ceiling fan cleaning apparatus according to claim 10, further comprising an adaptor electrically coupled to the motor to be connected to an electrical socket to provide power for driving the motor.

13. The ceiling fan cleaning apparatus according to claim 10, further comprising a pair of rotation bushes located at each end of the shaft to reduce friction and wear during the rotation movement.

14. A ceiling fan cleaning apparatus according to claim 10, further comprising a hinge bracket connected between a housing of the gear assembly and the elongated member to provide the angle adjustment function for the roller cleaner.

* * * * *